US006129507A

United States Patent [19]

Ganelin

[11] Patent Number: 6,129,507

[45] Date of Patent: Oct. 10, 2000

[54] METHOD AND DEVICE FOR REDUCING AXIAL THRUST IN ROTARY MACHINES AND A CENTRIFUGAL PUMP USING SAME

[75] Inventor: Boris Ganelin, Brooklyn, N.Y.

[73] Assignee: Technology Commercialization Corporation, New York, N.Y.

[21] Appl. No.: 09/302,866

[22] Filed: Apr. 30, 1999

[51] Int. Cl.[7] ..... F01D 49/07

[52] U.S. Cl. ..... 415/1; 415/106; 415/168.2; 415/211.2

[58] Field of Search ..... 415/1, 104, 105, 415/168.2, 208.1, 211.2, 106

[56] References Cited

U.S. PATENT DOCUMENTS

| | | | |
|---|---|---|---|
| 2,925,290 | 2/1960 | Greenwald | 415/106 |
| 4,170,435 | 10/1979 | Swearingen | 415/1 |
| 4,493,610 | 1/1985 | Iino | 415/104 |
| 4,538,960 | 9/1985 | Iino | 415/104 |
| 4,867,633 | 9/1989 | Gravelle | 415/106 |
| 4,892,459 | 1/1990 | Guelich | 415/104 |
| 5,102,295 | 4/1992 | Pope | 415/104 |
| 5,104,284 | 4/1992 | Hustak | 415/105 |
| 5,320,482 | 6/1994 | Palmer | 415/104 |
| 5,358,378 | 10/1994 | Holscher | 415/170.1 |
| 5,591,016 | 1/1997 | Kubota | 417/365 |
| 5,862,666 | 1/1999 | Liu | 60/726 |

FOREIGN PATENT DOCUMENTS

| | | | |
|---|---|---|---|
| 2698666 | 6/1994 | France | 415/104 |
| 1275120 | 12/1986 | U.S.S.R. | 415/104 |

OTHER PUBLICATIONS

Sivo JM, Acosta AJ, Brennen CE, Caughey TK. The influence of swirl brakes on the rotodynamic forces generated by discharge–to–suction leakage flows in centrifugal pumps. Transactions of ASME vol. 117, pp. 104–108, 1995.

Kurokawa J. Axial thrust behavior in LOX–pump of rocket engine. Journal of Propulsion and Power, vol. 10, No. 2, pp. 244–250, 1994.

Baskharone EA, Daniel AS, Hensel SJ. Rotodynamic effects of the shroud–to–housing leakage flow in centrifugal pumps. Transactions of ASME, vol. 116, pp. 558–562, 1994.

Bayley FJ, Long CA, Turner AB. Disks and drums: the thermo–fluid dynamics of rotating surfaces. Proc Instn Mech Engrs vol. 207, pp. 73–81, 1993.

Iino T, Sato H, Miyashiro H. Hydraulic axial thrust in multistage centrifugal pumps. Transactions of ASME vol. 102, pp. 64–69, 1980.

Senoo Y, Hayami H. An analysis on the flow in a casing induced by a rotating disk using a four–layer flow model. Transactions of ASME, Journal of fluids engineering, pp. 192–198, 1976.

*Primary Examiner*—Edward K. Look
*Assistant Examiner*—Hermes Rodriguez
*Attorney, Agent, or Firm*—Boris Leschinsky

[57] ABSTRACT

A method and device for reducing or eliminating axial thrust in a rotary machine such as a centrifugal pump or compressor by altering the fluid pressure in a cavity formed between a rotor and a housing. The device contains a disk placed along the rotor for subdividing the fluid in the cavity in such a way that all annular gap leakage flow is channeled and pumped through the space between that disk and the rotor from the center of the pump towards the periphery. As a result, the pressure in the cavity is altered to reduce and control the axial thrust on the rotor which becomes independent of the wear state of the shaft seals. In another embodiment, the step of flow subdividing is achieved by providing a set of braking vanes along the periphery of the cavity for reducing the rotational speed of the fluid coming from the cavity as well as from the annular gap and a stationary disk placed along the interior wall of the housing for directing the radial flow of that fluid towards the center of the pump.

26 Claims, 3 Drawing Sheets

METHOD AND DEVICE FOR REDUCING AXIAL THRUST IN ROTARY MACHINES AND A CENTRIFUGAL PUMP USING SAME

BACKGROUND OF THE INVENTION

1. Field of the Invention

The present invention relates generally to a method and device for reducing or eliminating the axial thrust commonly associated with rotary machines such as centrifugal, axial, turbo- and other rotary pumps, compressors, motors, pneumatic and hydraulic turbines, turbine engines and other similar machines. More specifically, the present invention relates to rotary machines having a sub-dividing disk located in the cavity between the rotor and the housing for changing the nature of pressure distribution along the outside of the rotor and reduce the dependency of the axial thrust on the wear state of the rotary machine seals.

2. Description of the Prior Art

Rotary machines are widely used in various industries. Centrifugal compressors and pumps, turbo-, gas-, and jet engines and pumps, axial flow pumps and hydraulic motors are just some examples of rotary machines. A typical single- or multi-staged rotary pump or compressor contains a rotor surrounded by a stationary shroud or housing. An active part of the rotor is sometimes also called an impeller which typically contains an arrangement of vanes, disks or other components forming a pumping element that transforms its kinetic rotational energy to the pumping fluid.

One known feature of practically all rotary machines is the presence of the axial force also known as axial thrust which impacts the performance of the rotor. Depending on the rotational speed, rotor diameter, fluid dynamics, annular gap leakage flows and many other parameters, the axial thrust produced may reach such significant levels and as such present a challenge to the longevity and reliability of the rotary machine operation. Axial load is especially harmful for the axial thrust bearings. Failure of the axial thrust bearing can cause general failure of the machine. Expensive procedures of bearing replacement comprises a significant part of the overall maintenance of the rotary machine, especially turbo-jet engines and similar machines in which access to the axial bearings is quite difficult. The need therefore exists for a device that would reduce or better yet make insignificant axial thrust in a rotary machine in order to improve its reliability and extend the time between repair services.

It is also known in the art of rotary machines that the level of axial thrust forces depends on the wear state of the rotor seals of the machine. As the seals wear out, the annular gap leakage flow increases which changes unfavorably the hydrodynamic nature of the vortex flows in the cavities between the rotor and the housing of the rotary machine and typically causes the increase in the axial thrust. That in turn causes higher loads on the axial thrust bearings and may bring about their premature failure.

The challenge of reducing the axial thrust has been long recognized by the designers of the rotary machines. A variety of concepts has been proposed in the prior art in attempt to solve this problem. One of the most popular methods of reducing the axial thrust is the use of a balancing disk or drum. A balancing drum or disk is added in the back of the rotor and placed in its own balancing cavity in such a way that one side of the disk is subjected to high fluid pressure in order to compensate for the axial thrust cumulatively developed in all the prior stages of the machine. Examples of various designs of such balancing disks can be found in U.S. Pat. No. 5,591,016 by Kubota; U.S. Pat. No. 5,102,295 by Pope; U.S. Pat. No. 4,892,459 by Guelich; as well as U.S. Pat. Nos. 4,538,960 and 4,493,610 by Iino. Although capable of reducing the axial thrust to a certain extent, these devices are not generally capable of eliminating the problem over a wide range of rotor speeds and pumping conditions. In addition, they are not as simple to implement, require their own maintenance service and increase the size, inertia and weight of the rotary machine which ultimately reduces its efficiency of operation. They also increase the annular gap leakage and in addition can not compensate for the increasing axial thrust due to the wear of the rotary machine seals.

Another method of axial thrust compensation is to increase the fluid pressure in the appropriate cavity of the rotary machine to exert higher pressure on the rotor and therefore to compensate for the axial thrust. Various additional fluid passages have been proposed in the rotary machines of the prior art for the purposes of creating conditions of changing the fluid pressure against the certain areas of the rotor. Examples of single- and multi-staged rotary machines utilizing these devices are described in U.S. Pat. No. 5,862,666 by Liu; U.S. Pat. No. 5,358,378 by Holscher; U.S. Pat. No. 5,104,284 by Hustak; and U.S. Pat. No. 4,170,435 by Swearingen. Rotary machines of this type employ complicated monitoring and control devices designed to adjust the leakage rates and the pressure values of the additional fluid passages in order to compensate for the axial thrust over a wide range of operating parameters. In addition to complexity, another limitation of this approach is the hydraulic losses associated with these compensating fluid passages which negatively affect the hydraulic and overall efficiency of the rotary machine. As with balancing disks, these devices require separate maintenance and thus increase the operation costs of the machine.

One of the simplest and quite efficient ways to address the problem of the axial thrust is the use of so called swirl brakes described for example in the U.S. Pat. No. 5,320,482 by Palmer or in the article by J. M. Sivo entitled "The influence of swirl brakes on the rotordynamic forces generated by discharge-to-suction leakage flows in centrifugal pumps" (Transactions of ASME, Volume 117, March 1995, pages 104–108). A plurality of stationary ribs, grooves, cavities or vanes located along the housing of the rotary machine are utilized to change favorably the fluid pressure distribution outside the rotor in order to reduce the axial thrust. Although simple and reliable, this method has its own limitations such as creating additional localized vortexes and areas of hydraulic disturbances in the rotary machine which reduces its hydraulic efficiency.

Finally, another method of axial thrust reduction is proposed in the U.S. Pat. No. 4,867,633 by Gravelle. Hydraulic thrust balance is achieved and continuously maintained according to that patent by the controlled axial movement of the rotor shaft and the rotor in order to modulate the gap at the rear seal and therefore control the pressure acting on the back side of the rotor. In that case, an outward thrust force resulting from the rotor operation counterbalances an inward thrust force resulting from the pressure acting on the front side of the rotor. This device is quite complicated and delicate and requires careful adjustment for proper operation. It also reduces the hydraulic efficiency of the machine.

The need exists therefore for a device to reduce axial thrust that is simple in design, is easy to install in existing rotary machines, does not require monitoring and control devices in order to work properly, and is effective in its function over a wide range of operating parameters of the rotary machine.

The need also exists for a device to reduce and control axial thrust that would allow to reduce or preferably eliminate completely the dependency of the axial thrust forces on the wear state of the seals in a rotary machine.

SUMMARY OF THE INVENTION

Accordingly, it is an object of the present invention to overcome these and other drawbacks of the prior art by providing a novel method and device for reducing the axial thrust in a rotary machine such as a rotary pump or compressor by subdividing the flow in a cavity formed between the rotor and the housing of the rotary pump into at least two flows so that at least one flow is separated from the cavity in such a way that the pressure distribution on the rotor in that cavity is affected in a way needed for reduction of the overall axial thrust on the rotor.

It is another object of the present invention to provide a method and device for reducing the axial thrust in a rotary machine by separating the flow in the cavity formed between the rotor disk and the housing into at least two flows so that one flow is shielded from the cavity and flows mostly along the rotor disk of the machine.

It is a further object of the invention to provide a method and a device for reducing the axial thrust in a rotary machine by providing a secondary pump along the rotor to compensate for and even reverse the direction of the annular gap leakage flow in the cavity between the rotor and the housing and therefore affect the fluid pressure distribution on the rotor in such a way that the overall axial thrust on the rotor of the machine is reduced.

It is yet another object of the present invention to provide a method and device for reducing the axial thrust in a rotary machine by separating a flow in the cavity formed between the rotor disk and the housing into at least two flows so that one flow is shielded from the cavity and flows mostly along the housing of the machine following substantial reduction of its rotational speed along the periphery of the housing.

It is yet another object of the invention to provide a method and device for reducing the rotational speed of the fluid along the housing periphery of a rotary machine in the cavity formed between the rotor disk and the housing and for directing that fluid towards the center of the machine along the housing wall without any substantial rotation of that fluid so that the pressure distribution in the cavity is changed in such a way that the overall axial thrust on the rotor of the rotary machine is reduced or effectively eliminated.

It is yet another object of the present invention to provide a method and device to substantially reduce or eliminate the dependency of the axial thrust forces on the wear state of the seals of the rotary machine.

According to the method of the invention, the pressure distribution in one or more cavities formed between the rotor disks and the housing walls of the rotary pump can be positively affected so that the axial thrust resulting from the fluid pressure acting upon the disks of the rotor is reduced or eliminated. In order to achieve that pressure distribution change, the structure and the dynamics of the vortex flow typically present in a cavity between a rotor disk and a housing wall is changed in the following way. The flow is subdivided into at least two separate flows so that the first flow is moved through a separate dedicated channel organized to shield it from the cavity. In that case, the second flow residing in the cavity has a different dynamic nature and a different pressure distribution in comparison to the prior art pumps. That difference in the nature of the second flow allows in turn to control and adjust the pressure distribution along the rotor disk and thus reduce the axial thrust on the rotor of the machine.

The dedicated channel for the first flow may be organized by having a secondary disk placed along the housing wall in case the annular gap leakage is directed from the periphery of the pump to its center such as may be the case in a single stage centrifugal pump. Breaking vanes to reduce rotational speed are placed along the stationary periphery of the cavity in order to reduce the tangential movement of the fluid prior to directing it into the channel. Alternately, in case of a middle rotor of a multi-stage rotary pump where the direction of the annular gap leakage is the opposite, the dedicated channel is organized along the rotor disk itself.

The method of the invention allows to substantially reduce or even eliminate the effect of the wear state of the seals of the machine on the axial thrust. By having the first flow being always higher than the gap leakage flow, the contribution of that gap leakage flow to axial thrust is sufficiently diminished and reliability of the machine is improved. As such, the periods of time between seals and bearings service can be significantly increased therefore reducing the overall maintenance cost for the rotary machine.

In addition to the general use centrifugal pumps, compressors and other turbo machines, the present invention is particularly useful in rotary machines used for water and air supply, for oil and natural gas recovery, refinement and transport, in chemical and food processing industry, for power plants including nuclear power plants, for turbine engines and particularly jet engines as well as in a number of other applications.

BRIEF DESCRIPTION OF THE DRAWINGS

A more complete appreciation of the subject matter of the present invention and its various advantages can be realized by reference to the following detailed description in which reference is made to the accompanying drawings in which.

DETAILED DESCRIPTION OF THE INVENTION

Figure 1A:
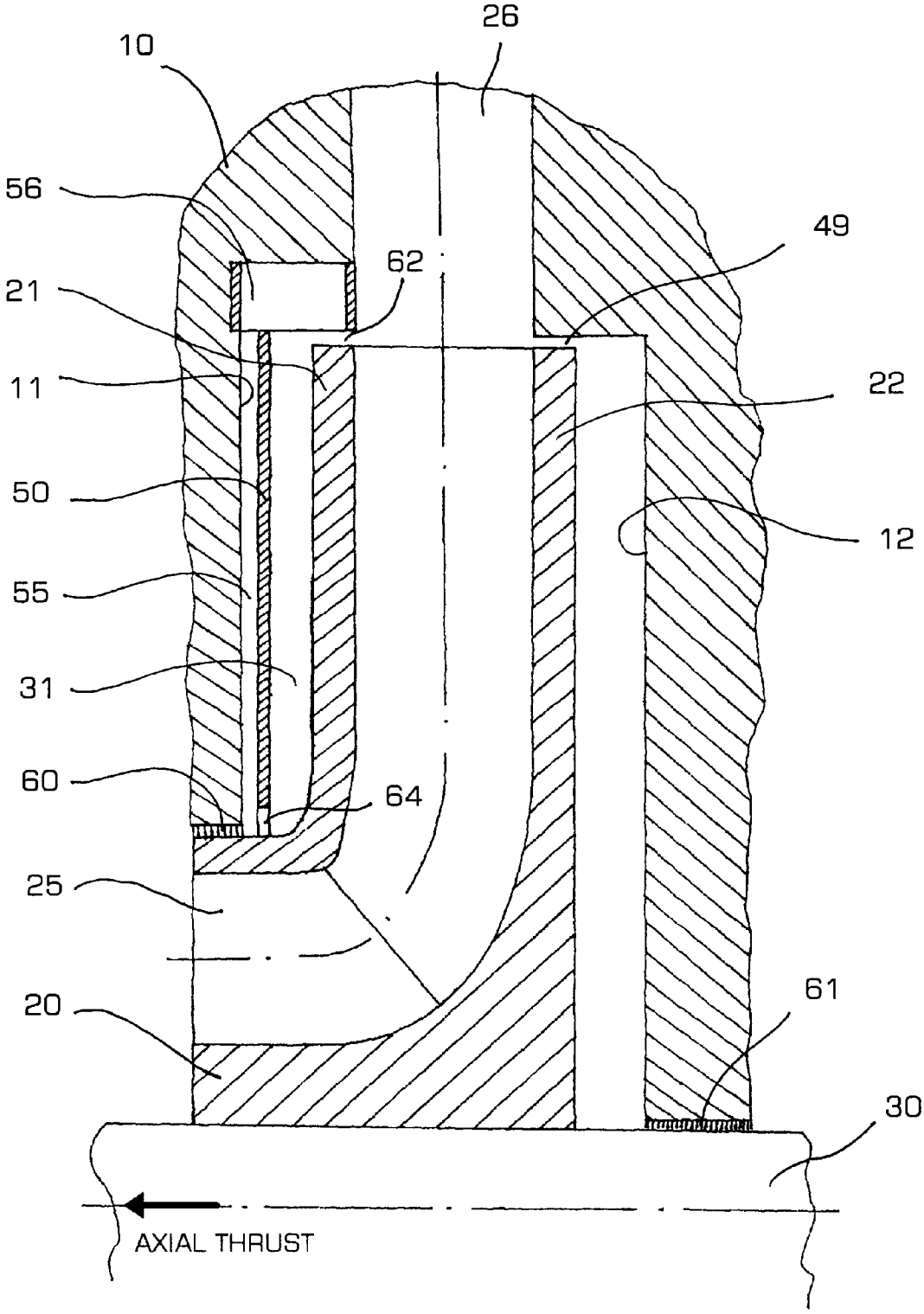
FIG. 1A is a cross-sectional view of a fragment of a rotary machine such as a centrifugal pump or compressor equipped with a device for reduction of axial thrust according to the first embodiment of the invention.

A detailed description of the present invention follows with reference to the accompanying drawings in which like elements are indicated by like reference numerals.

Figure 1B:
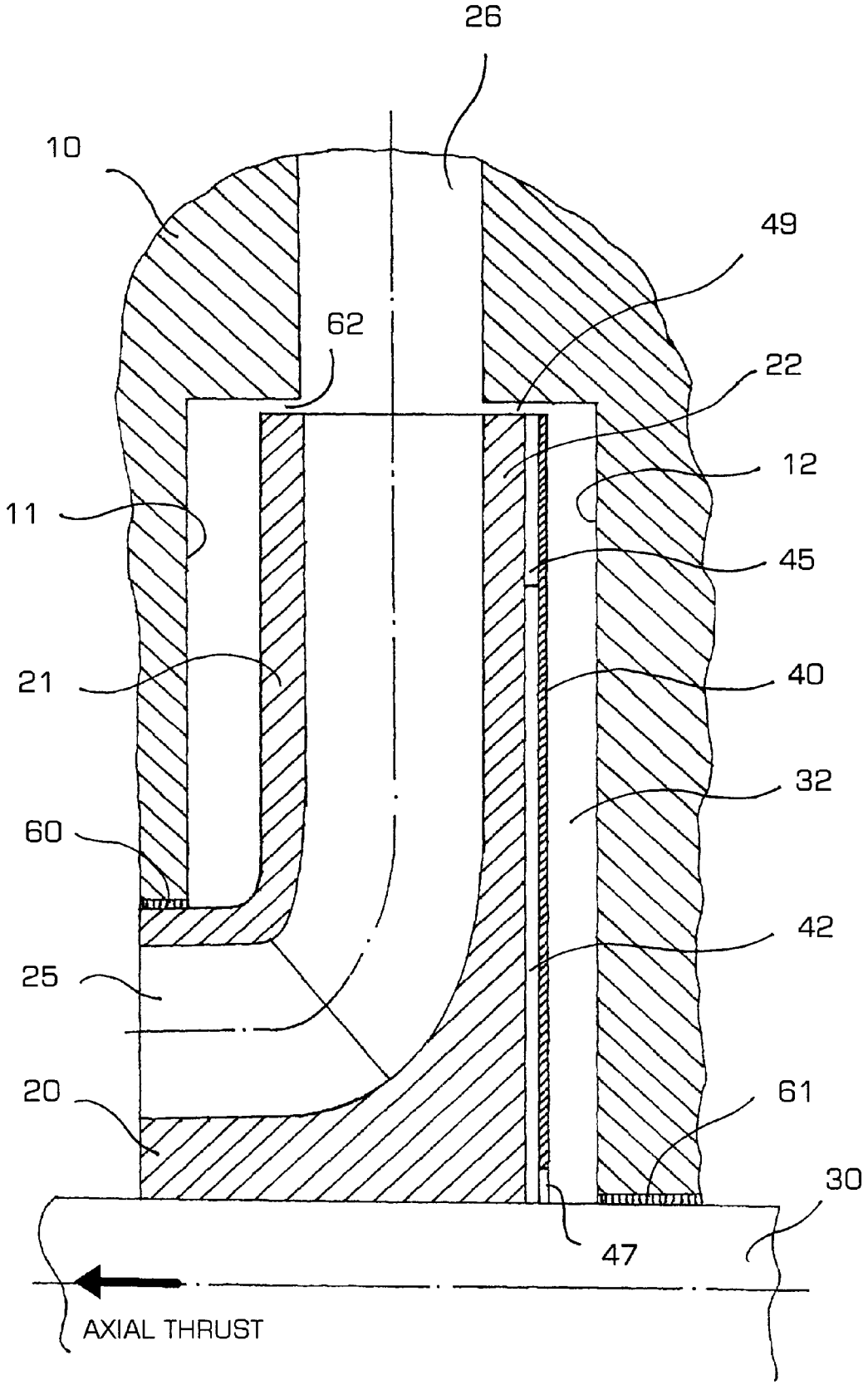
FIG. 1B is a cross-sectional view of a fragment of a rotary machine such as a centrifugal pump or compressor equipped with a device for reduction of axial thrust according to the second embodiment of the invention.

FIGS. 1A and 1B illustrate a fragment of one of the stages of a typical centrifugal pump that may contain one or more stages. The pumping element of the rotor is sometimes referred to as the impeller. Although the geometry of the rotor may vary according to the pumping conditions such as in the so-called radial, mixed flow or axial pumps, they all have the same basic elements, namely the rotor having a front surface and a rear surface, a housing containing that rotor, and seals minimizing the leaks from the high pressure areas at the outlet of the pump to the low pressure areas at the inlet of the pump. The present invention is illustrated only with reference to the radial flow type centrifugal pump but it can be easily adapted by those skilled in the art to other types of rotary machines.

As shown on FIG. 1, centrifugal pump consists of a housing (10), containing a rotor (20) located on the central shaft (30). The rotor (20) includes the front disk (21) shown to the left side of the FIG. 1 and the rear disk (22) shown to the right of the FIG. 1 so that these disks serve to direct the fluid flow from the low pressure area at the inlet (25) to the high pressure area at the outlet (26).

Two cavities are formed between the rotor (20) and the housing (10): front cavity (31) and rear cavity (32). Front cavity (31) is defined generally by the front interior housing wall (11), front annular pressure gap (62), front disk (21), and front seal (60). Rear cavity (32) is defined respectively by the rear interior housing wall (12), shaft seal (61), rear disk (22) and rear annular gap (49). Cumulative axial thrust on the rotor (20) is a result of the pressure distribution along the front disk (21) and the rear disk (22) in these two respective cavities (31) and (32). In turn, these pressure distributions directly depend on the fluid dynamics in these cavities, the discussion of which will now follow.

General pressure distribution theory and the flow dynamics in a cavity formed between the stationary housing and the rotating disk has been described in the prior art. One example of a detailed hydrodynamic analysis of this situation can be found in the article by Y. Senoo and H. Hayami entitled "An analysis on the flow in a casing induced by a rotating disk using a four-layer flow model" published in Transactions of the ASME, June 1976, p. 192–198 which is incorporated here in its entirety by reference. Assuming no leaks in the gaps between the rotating disk and the housing, this article contains a theoretical model and an experimental confirmation of a "rotating core" flow dynamics in a cavity similar to that depicted on FIGS. 1A and 1B as having four general zones as shown on FIG. 2:

zone 1 in which the housing wall boundary layer flows down the housing from the high pressure area in the periphery of the pump towards the central shaft;

zone 2 in which the radial speed of flow changes direction and the outward flow layer flows back in the radial direction;

zone 3 in which the "rotating core" layer fluid has only tangential speed and no radial speed (in other words, fluid moves strictly in rotation but no flow occurs radially), and finally zone 4 in which the drag from the rotating disk moves the disk boundary layer fluid both tangentially and radially towards the periphery of the pump and the tangential speed of the fluid $V_t$ is approaching the value dictated by the rotational speed of the disk $\omega$ multiplied by the radial coordinate r.

Tangential $V_t$ and radial fluid speed $V_r$ distribution charts in the cavity along the axial dimension in all four zones as described by Y. Senoo and H. Hayami in the article are shown on FIG. 2. According to the article and as generally known from the fluid dynamics theory, the fluid "rotating core" is formed between the disk and the housing in zone 3 and the tangential speed of that core is about one half of the rotational speed of the disk. A vortex flow is formed along the edges of the cavity so that the fluid is moved mostly outwardly near the disk and returned mostly in the direction towards the center along the housing wall. Clearly, the outward flow level is equal to the flow level along the housing wall in the opposite direction provided again that there are no outside leaks in or out of the cavity.

Figure 3:
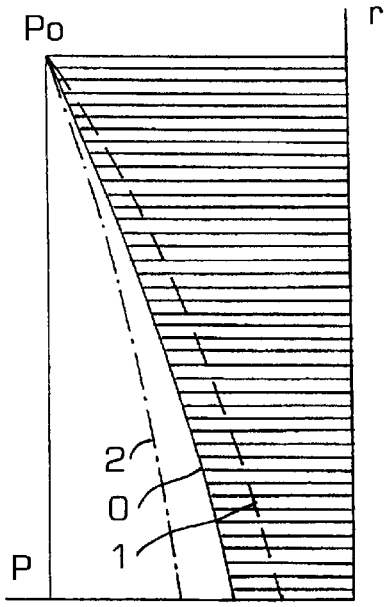
FIG. 3 is the chart of the fluid pressure distribution P along the rotating disk radius coordinate r of the pump shown in FIG. 2.

There being a direct relationship between the tangential speed of the core and the rotational speed of the disk in the "rotating core" model of fluid dynamics in turn allows to describe the distribution of fluid pressure along the rotating disk in that cavity. The pressure distribution along the radial coordinate of the disk can be described using the following equation for the "rotating core":

$$dP/dr=\rho\omega_c^2 r,$$

in which P is the pressure in the cavity, r is the disk radial coordinate, $\omega_c$ is the angular velocity of the fluid in the "rotating core" and $\rho$ is the fluid density. Since the width of the cavity is much smaller then its length, it is assumed and was confirmed experimentally that the distribution of pressure along the axial dimension of the cavity is constant. The parabolic curve of the pressure is generally shown on FIG. 3 as curve 0 (for no gap leaks). As shown on FIG. 3, the maximum pressure $P_0$ on the periphery of the pump is gradually reducing towards the center of the disk. The nature of these pressure curves is the same for both the front and the rear cavities in a typical centrifugal pump. Therefore, the cumulative axial thrust results from the force generating by these pressures on both the front and the rear disks of the rotor.

Gap leaks which are unavoidable in centrifugal pumps, effect the fluid dynamics in the cavities and shift the pressure curves. Depending on the design of the centrifugal pump, gap leaks may flow in different directions. In case of a single stage centrifugal pump, the high pressure area in the periphery typically forces annular gap leaks in the direction from the periphery towards the low pressure central area of the shaft in both the front and the rear cavities of the pump. That in turn increases the pressure gradient along the disk and shifts the pressure curve on FIG. 3 from curve 0 to curve 1.

In a middle section of a multistage centrifugal pump however, the pressure in the following stage is typically higher than the pressure in the previous stage and therefore, the direction of the annular gap leak in the rear cavity may have the opposite direction, namely from the center towards the periphery. In that case, the gap leakage contributes to the reduction in the pressure gradient and subsequent shift of the pressure curve from curve 0 to curve 2 as shown on FIG. 3.

Annular gap leakages have a significant effect on the pressure distribution along the rotor. Wear of the seals and gaskets impact the total gap leakage flow and therefore the axial thrust of the rotary machine. As such, the wear of the seals causes the increase of the gap leakage which in turn causes the increase in the axial thrust. That, in turn increases the load on the axial thrust bearing and can cause their failure. It is therefore important to reduce or better completely eliminate the dependency of axial thrust on the function of the rotor seals in a rotary machine.

The present invention can be utilized with one of two or both embodiments described below depending on the direction of that annular gap leakage. The first embodiment is used in situations where the annular gap leakage in the cavity is flowing towards the periphery of the pump and the second embodiment is used in situations where the annular gap leakage is flowing towards the center.

DETAILED DESCRIPTION OF THE FIRST PREFERRED EMBODIMENT OF THE INVENTION

Figure 2:
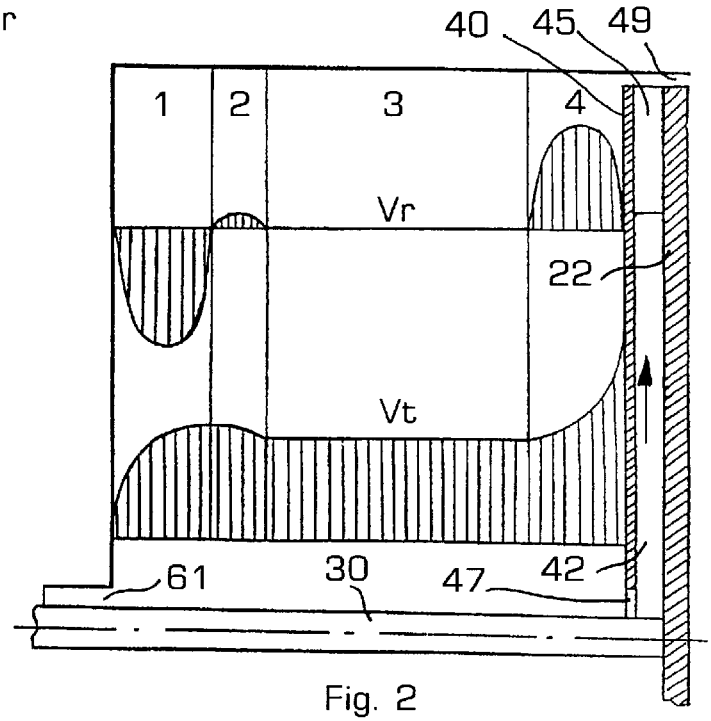
FIG. 2 is a cross-sectional view of the cavity formed between the rotary machine disk and the housing wall and the axial thrust reduction device according to the first embodiment of the invention. Tangential $V_t$ and radial fluid speed $V_r$ distribution charts in the cavity are also shown.

The first embodiment of the invention is illustrated on FIGS. 1A and 2 and is depicted in the area of the rear disk (22). The flow in the cavity (32) is subdivided into two flows by the presence of the disk (40) mounted along the main rear disk (22): the first flow is flowing in the channel (42) formed between the disks (22) and (40) and the second flow is flowing in the remaining part of the cavity (32) and is similar in nature to the typical vortex flow in a cavity of a centrifugal pump examined above. Disk (40) may be attached to the rotor (20) on struts (not shown) or with other appropriate means of attachment. Disk (40) is designed to pump fluid from the center to the periphery of the housing (10) when the rotor (20) is rotating during the normal operation of the centrifugal pump. For that purpose, secondary vanes (45) may be optionally added or, alternatively, the so-called "friction" pump may be designed in case the distance between disks (40) and (22) is small enough for that purpose. In any case, secondary flow results from the presence of the disk (40). That flow initiates from the disk inlet (47) and exits in the vicinity of the rear pressure gap (49).

Explanation of the positive hydrodynamic effect of the first embodiment of the present invention can be better illustrated assuming that the fluid flow generated by the disk (40) is generally equal in value to the annular gap leakage flow entering the cavity (32) from the rear shaft seal (61) and exiting into the gap (49) and further into the outlet (26). As was described above, the presence of the annular gap leakage generally shifts the pressure curve on FIG. 3 from curve 0 to curve 2. If the secondary flow from the disk (40) is equal in value to the annular gap leakage flow, it is easy to understand that in essence all leakage fluid will flow from the shaft seal (61) into the disk inlet (47), through the channel (42) to the periphery of the pump and exit through the gap (49). As such, that flow would substitute the gap leakage flow normally traveling through the cavity (32) and disrupting the axial thrust balance. The presence of the disk (40) will therefore "compensate" for the annular gap leakage or, in other words, will be equal hydrodynamically to providing "ideal" seals and would shift the pressure curve on FIG. 3 from curve 2 back to curve 0.

Now it would be easy to understand that should the secondary fluid flow generated by the disk (40) be greater then the annular gap leakage flow, the pressure curve would shift even further in the direction of the curve 1. Therefore, the present invention presents the means to control the pressure distribution curve along the disk (40) and thus along the rotor (20) in a way that is effectively independent of the wear of the rotor seals. It can be achieved if the flow from the disk (40) be significantly, at least 10 times greater than the leakage flow, in which case the resultant flow would be effected by the wear of the seals in such a minimal way as to be of no consequences to the operation of the pump. Therefore, the present invention provides the designer of the centrifugal pump with an ability to design the pump in a way that the axial thrust is balanced and will remain balanced throughout the life of the seals therefore increasing reliability and extending the time between the costly seal replacement procedures.

DETAILED DESCRIPTION OF THE SECOND PREFERRED EMBODIMENT OF THE INVENTION

Figure 5:
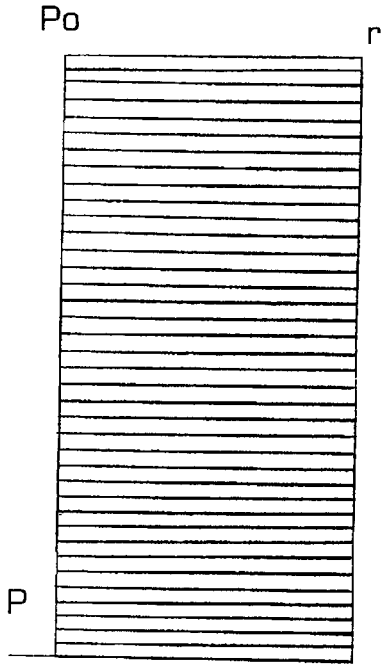
FIG. 5 is the chart of the fluid pressure distribution P along the rotating disk radius coordinate r of the pump shown in FIG. 4.
Figure 4:
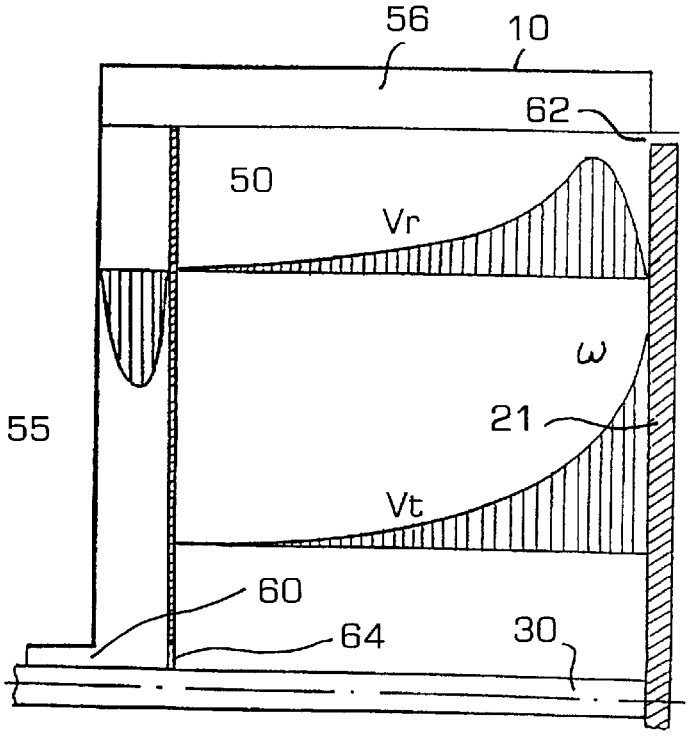
FIG. 4 is a cross-sectional view of the cavity formed between the rotary machine disk and the housing wall and the axial thrust reduction device according to the second embodiment of the invention. Tangential $V_t$ and radial fluid speed $V_r$ distribution charts in the cavity are shown; and finally

Attention is now called to FIGS. 1B, 4, and 5 depicting the design and hydrodynamic characteristics of the second embodiment of the present invention. This embodiment should be utilized in case the annular gap leakage flows in the direction from the periphery of the pump towards its center.

FIG. 1B illustrates a fragment of the centrifugal pump or compressor designed according to the second embodiment of the invention as having a cavity formed between the housing wall (11) and the front rotor disk (21) subdivided by a stationary disk (50) placed along the housing wall (11) using any known means of attachment such as struts or the like (not shown). The disk (50) divides the cavity into two portions: housing channel (55) and rotor cavity (31). A stationary system of breaking vanes (56) is placed on the periphery of the pump housing (10) and is designed to reduce or preferably eliminate any tangential speed of the fluid coming from cavity (31) and from annular gap leakage from annular gap (62). Braking vanes (56) are designed in such a way that any rotational component of the movement of all fluid coming up from the cavity (31) and from the annular gap (62) is eliminated while the fluid is shielded from the cavity (31) and directed down the channel (55). At the bottom of the channel, the fluid is divided into the seal leakage flow going across the seal (60) and a circulation flow going into the space (64) and back into the cavity (31). It is important to point out that if designed properly, the seal flow is significantly less than the total channel (55) flow and as such its influence is significantly reduced. As the seal wears out, increase in the seal flow will not impact the axial thrust and the overall performance of the pump.

Braking vanes (56) and the disk (50) change substantially the hydrodynamic characteristics of the flow in the cavity (31). Instead of the four-layer flow model described above for a typical case of a rotating disk, no "rotating core" exists now in the cavity (31). As such, a simple "one-zone" distribution of tangential and radial speeds of the fluid in the cavity (31) is formed and shown on FIG. 4. Note that no tangential speed preferably exists in the channel (55) as all fluid moves radially towards the center of the pump. That new overall speed distribution changes the nature of the pressure distribution as shown on FIG. 5. The pressure is constant along the rotor disk and is the same near the center as it is at the periphery. That simple pressure distribution which does not depend on the annular gap leakage flows or the wear state of the seals allows to calculate the axial thrust with high degree of confidence and to design the rotary machine with a balanced thrust that will not change its nature throughout the useful life of the machine.

One useful variation of the design of the disk (50) includes the presence of perforations along the central portion of the disk (not shown). The diameter and location of such perforations can be chosen so as not to create additional turbulent flows or vortexes that may effect negatively the overall efficiency of the pump. The advantage of having these perforations is to improve flow distribution and pressure distribution between channel (55) and the cavity (31).

One of the important advantages of the present invention is the ability to to narrow the range of axial thrust in order to allow the use of axial bearings that otherwise can not be used in a rotary machine. One example of these bearings is the magnetic bearings. Typically, magnetic bearings are attractive because of their simplicity and other desirable features but can operate only in a vary narrow range of axial forces and therefore are not routinely used in centrifugal pumps. The present invention allows for designing the rotary machine with a predictable and balanced axial thrust and therefore increases the possibility of using the magnetic bearings in these machines.

Although the present invention is described for a specific radial flow centrifugal pump, it is not limited thereto. Numerous variations and modifications would be readily appreciated by those skilled in the art and are intended to be included in the scope of the invention, which is restricted only by the following claims.

I claim:

1. A method for reducing axial thrust in a rotary machine, said machine comprising a housing with a center and a periphery, said housing containing a fluid inlet, a fluid outlet, a shaft rotatably mounted in said center, a rotor mounted on said shaft, said rotor having at least one radial surface, said housing having at least one interior wall surface proximate said radial surface of said rotor and defining a cavity therebetween, said cavity having a central area proximal the center of said housing and a peripheral area proximal the periphery of said housing, said method comprising the steps of:

subdividing a fluid flow in said cavity into a first fluid flow and a second fluid flow; and channeling said first fluid flow between said peripheral area and said central area while shielding it from said second fluid flow, whereby the fluid pressure of said second fluid flow in said cavity being altered in order to reduce the axial thrust on said rotor.

2. The method as in claim 1, wherein said rotary machine further comprising at least one annular gap formed between said rotor and said housing proximate the peripheral area of said cavity, and the step of subdividing of said fluid flow further comprising a step of including substantially all fluid flow flowing through said annular gap into said first flow, whereby reducing the effect of said annular gap fluid flow on the fluid pressure of said second fluid flow in said cavity.

3. The method as in claim 2, wherein said rotary machine further comprising at least one shaft seal for minimizing the fluid leakage from said cavity, and the step of subdividing the fluid flow further comprising a step of providing the first fluid flow being at least equal or greater than the leakage flow through said shaft seal.

4. The method as in claim 3, wherein the step of subdividing the fluid flow further comprising a step of providing said first fluid flow being at least 10 times greater than said shaft seal leakage flow, whereby the axial thrust on the rotor being substantially independent from the wear state of said shaft seal.

5. The method as in claim 1, wherein the step of subdividing said fluid flow further comprising a step of providing a disk pumping means attached along said radial surface of said rotor for defining and pumping said first fluid flow from the central area to the peripheral area of said cavity.

6. The method as in claim 1, wherein said step of subdividing said fluid flow further comprising a step of reducing the fluid rotational speed in the peripheral area of said cavity and forming said first fluid flow, said step for channeling further comprising a step of providing a stationary disk means attached along said interior wall of said housing for directing said first fluid flow towards the central area of said cavity.

7. A device for reducing axial thrust in a rotary machine, said machine comprising a housing with a center and a periphery, said housing containing a fluid inlet, a fluid outlet, a shaft rotatably mounted in said center, a rotor mounted on said shaft, said rotor having at least one radial surface, said housing having at least one interior wall surface proximate said radial surface of said rotor and defining a cavity therebetween, said cavity having a central area proximate to the center of said housing and a peripheral area proximate to the periphery of said housing, said device comprising:

a means for subdividing a fluid flow in said cavity into a first fluid flow and a second fluid flow; and a means for channeling said first fluid flow between said peripheral area and said central area of said cavity while shielding it from said second fluid flow, whereby the fluid pressure of said second fluid flow in said cavity being altered in order to reduce the axial thrust on said rotor.

8. The device as in claim 7, wherein said rotary machine further comprising at least one annular gap formed between said rotor and said housing proximate the peripheral area of said cavity, and the means for subdividing accepting substantially all fluid flow flowing through said annular gap and including said annular gap flow into said first flow, whereby reducing the effect of said annular gap fluid flow on the fluid pressure of said second fluid flow in said cavity.

9. The device as in claim 7, wherein said rotary machine further comprising at least one shaft seal for minimizing the fluid leakage from said cavity, and the means for subdividing the fluid flow further providing the first fluid flow being at least equal or greater than the leakage flow through said shaft seal.

10. The device as in claim 9, wherein the means for subdividing the fluid flow providing said first flow being at least 10 times greater than said shaft seal leakage flow, whereby the axial trust on the rotor being substantially independent from the wear state of said shaft seal.

11. The device as in claim 7, wherein the means for subdividing said fluid flow further comprising a disk pumping means placed along said radial surface of said rotor for defining and pumping said first fluid flow from the central area to the peripheral area of said cavity.

12. The device as in claim 11, wherein said disk pumping means comprising a disk placed in proximity to the radial surface of said rotor and a set of vanes located between said disk and said rotor for pumping the first fluid flow towards the periphery of said cavity.

13. The device as in claim 11, wherein said disk pumping means comprising a disk placed in proximity to the radial surface of said rotor, whereby a friction pump being formed in the space between the radial surface of said rotor and said disk, said friction pump being capable of pumping the first fluid flow towards the periphery of said cavity.

14. The device as in claim 7, wherein said means for subdividing said fluid flow further comprising a stationary braking means for reducing the fluid rotational speed in the peripheral area of said cavity and forming said first fluid flow, said means for channeling further comprising a stationary disk means attached along said interior wall of said housing for directing said first fluid flow towards the central area of said cavity.

15. The device as in claim 14, wherein said stationary braking means being a set of braking vanes placed in the peripheral area of said cavity.

16. The device as in claim 14, wherein said stationary disk further incorporating a set of perforations for equalizing the fluid pressure between the first and the second fluid flow in the central area of said cavity.

17. A centrifugal pump with reduced axial thrust comprising:

a housing with a center and a periphery, said housing containing a fluid inlet and a fluid outlet, said housing having at least one interior wall surface, a shaft rotatably mounted in said center, a rotor mounted on said shaft, said rotor having at least one radial surface proximate said interior wall surface of said housing, a cavity formed between said radial surface of said rotor and said interior wall surface of said housing, said cavity having a central area proximate to the center of said housing and a peripheral area proximate to the periphery of said housing, a means for subdividing a fluid flow in said cavity into a first fluid flow and a second fluid flow; and a means for channeling said first fluid flow between said peripheral area and said central area of said cavity while shielding it from said second fluid flow, whereby the fluid pressure of said second fluid flow in said cavity being altered in order to reduce the axial thrust on said rotor.

18. The centrifugal pump as in claim 17, said pump further comprising at least one annular gap formed between said rotor and said housing proximate the peripheral area of said cavity, and the means for subdividing accepting substantially all fluid flow flowing through said annular gap and including said annular gap flow into said first fluid flow, whereby reducing the effect of said annular gap fluid flow on the fluid pressure of said second fluid flow in said cavity.

19. The centrifugal pump as in claim 17, said pump further comprising at least one shaft seal for minimizing the fluid leakage from said cavity, and the means for subdividing the fluid flow further providing the first fluid flow being at least equal or greater than the leakage flow through said shaft seal.

20. The centrifugal pump as in claim 19, wherein the means for subdividing the fluid flow providing said first fluid flow being at least 10 times greater than said shaft seal leakage flow, whereby the axial thrust on the rotor being substantially independent from the wear state of said shaft seal.

21. The centrifugal pump as in claim 17, wherein the means for subdividing said fluid flow further comprising a disk pumping means placed along said radial surface of said rotor for defining and pumping said first fluid flow from the central area to the peripheral area of said cavity.

22. The centrifugal pump as in claim 21, wherein said disk pumping means comprising a disk placed in proximity to the radial surface of said rotor and a set of vanes located between said disk and said rotor for pumping the first fluid flow towards the periphery of said cavity.

23. The centrifugal pump as in claim 21, wherein said disk pumping means comprising a disk placed in proximity to the radial surface of said rotor, whereby a friction pump being formed in the space between the radial surface of said rotor and said disk, said friction pump being capable of pumping the first fluid flow towards the periphery of said cavity.

24. The centrifugal pump as in claim 17, wherein said means for subdividing said fluid flow further comprising a stationary braking means for reducing the fluid rotational speed in the peripheral area of said cavity and forming said first fluid flow, and said means for channeling further comprising a stationary disk means attached along said interior wall of said housing for directing said first fluid flow towards the central area of said cavity.

25. The centrifugal pump as in claim 24, wherein said stationary braking means being a set of braking vanes placed in the peripheral area of said cavity.

26. The centrifugal pump as in claim 24, wherein said stationary disk further incorporating a set of perforations for equalizing the fluid pressure between the first and the second fluid flow in the central area of said cavity.

* * * * *